US008266721B1

(12) United States Patent
Mueller

(10) Patent No.: US 8,266,721 B1
(45) Date of Patent: Sep. 18, 2012

(54) HEAD WEAR SPECIFICALLY BUT NOT EXCLUSIVELY FOR PEOPLE EXPERIENCING HAIR LOSS

(76) Inventor: Karen L. Mueller, York, PA (US)

( * ) Notice: Subject to any disclaimer, the term of this patent is extended or adjusted under 35 U.S.C. 154(b) by 296 days.

(21) Appl. No.: 12/802,210

(22) Filed: Jun. 2, 2010

(51) Int. Cl.
*A42B 1/06* (2006.01)

(52) U.S. Cl. ..... 2/171; 2/172; 2/209.13

(58) Field of Classification Search ..... 2/171, 172, 2/173, 181, 183, 174, 202, 203, 204, 209.13, 2/175.3, 175.6, 195.7, 175.1, 244, 423, 424, 2/10, 12; D2/870, 873, 878, 879, 895, 894, D2/867
See application file for complete search history.

(56) References Cited

U.S. PATENT DOCUMENTS

| | | | | | |
|---|---|---|---|---|---|
| D22,645 | S | * | 7/1893 | Gutlohn | D2/895 |
| 1,274,652 | A | * | 8/1918 | Winget | 2/181 |
| 1,421,602 | A | * | 7/1922 | Spector et al. | 66/171 |
| 1,471,724 | A | * | 10/1923 | Ensten | 2/172 |
| 1,541,810 | A | * | 6/1925 | Hamilton | 2/68 |
| 1,629,188 | A | * | 5/1927 | Warren | 2/172 |
| 1,742,314 | A | * | 1/1930 | Husman | 2/174 |
| 1,766,749 | A | * | 6/1930 | Husman | 2/174 |
| 1,816,346 | A | * | 7/1931 | Silverstein | 2/172 |
| 1,957,206 | A | * | 5/1934 | Goldstein | 2/172 |
| 2,086,359 | A | * | 7/1937 | Gordon | 2/200.3 |
| 2,446,122 | A | * | 7/1948 | Bills | 2/174 |
| 2,560,267 | A | * | 7/1951 | Baker et al. | 132/273 |
| 2,644,949 | A | * | 7/1953 | Greenberg et al. | 2/181 |
| 3,276,038 | A | * | 10/1966 | Fekete | 2/172 |
| 3,529,308 | A | * | 9/1970 | McBride | 2/174 |
| 4,406,296 | A | * | 9/1983 | Wexler et al. | 132/148 |
| 4,491,985 | A | * | 1/1985 | Dalton | 2/172 |
| 4,599,749 | A | * | 7/1986 | Childs et al. | 2/204 |
| 5,083,318 | A | * | 1/1992 | Hook | 2/207 |
| 5,119,514 | A | * | 6/1992 | Woehl | 2/172 |
| 6,223,355 | B1 | * | 5/2001 | Irving | 2/171 |
| 6,289,903 | B1 | * | 9/2001 | Haufler | 132/275 |
| 2010/0058515 | A1 | * | 3/2010 | Castle | 2/207 |

* cited by examiner

*Primary Examiner* — Amy Vanatta

(57) ABSTRACT

An artful head covering made of cloth and other materials, existing in three embodiments, each sequentially dependent on the one before it. All embodiments including a cap portion comprised of a curved upper crown with a straight lower edge connected to a band portion comprised of a straight upper edge and a curved lower edge. The second embodiment has fasteners attached to the exterior of the cap portion of the head covering for added dimension along with serving a function in the third embodiment in which strands comprised of additional fasteners and artful objects are connected to some or all of the fasteners of embodiment 2. The head covering is secure and covers the portion of the head that is normally covered with hair. A fun and creative head covering for hair loss, or solely for fashionable purposes, that is comfortable and flattering to the face.

13 Claims, 15 Drawing Sheets

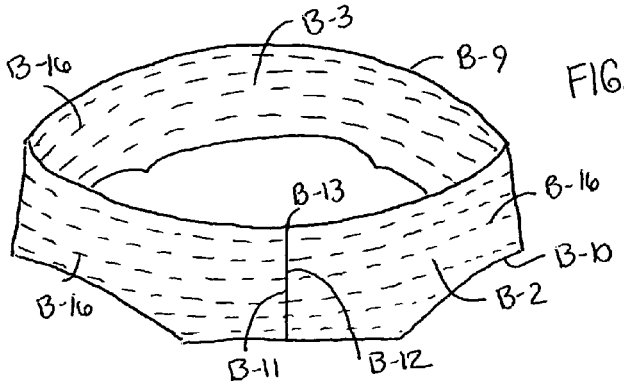
FIG. 15
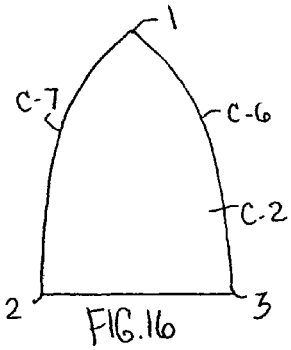
FIG. 16
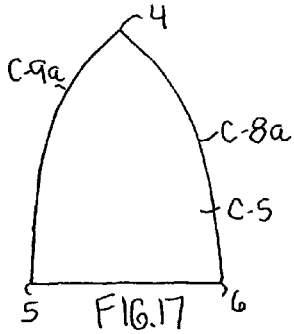
FIG. 17
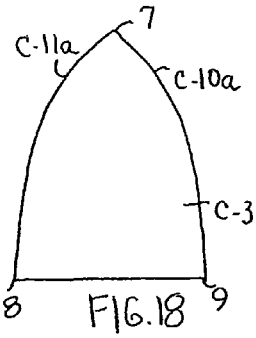
FIG. 18
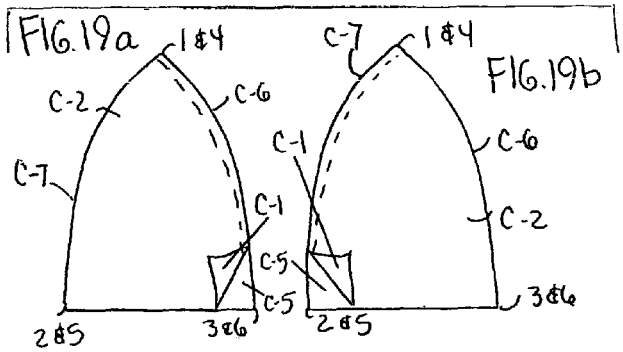
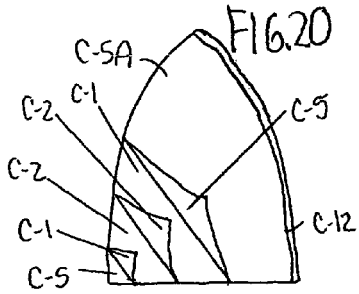

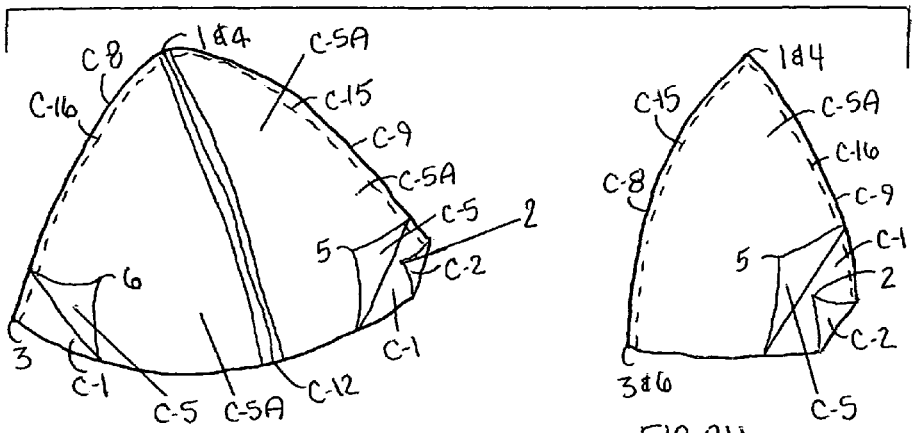
FIG.21a
FIG.21b
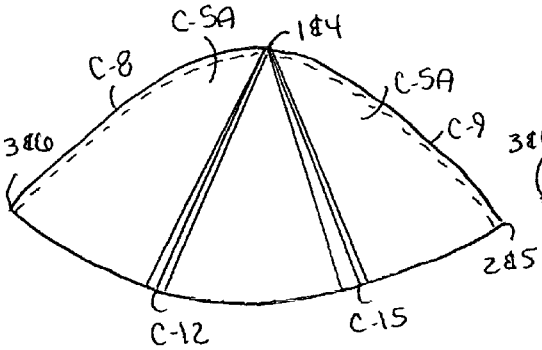
FIG.23
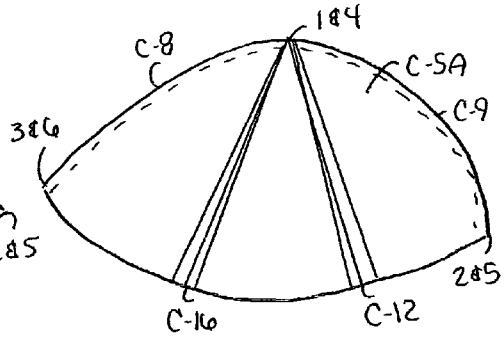
FIG.24

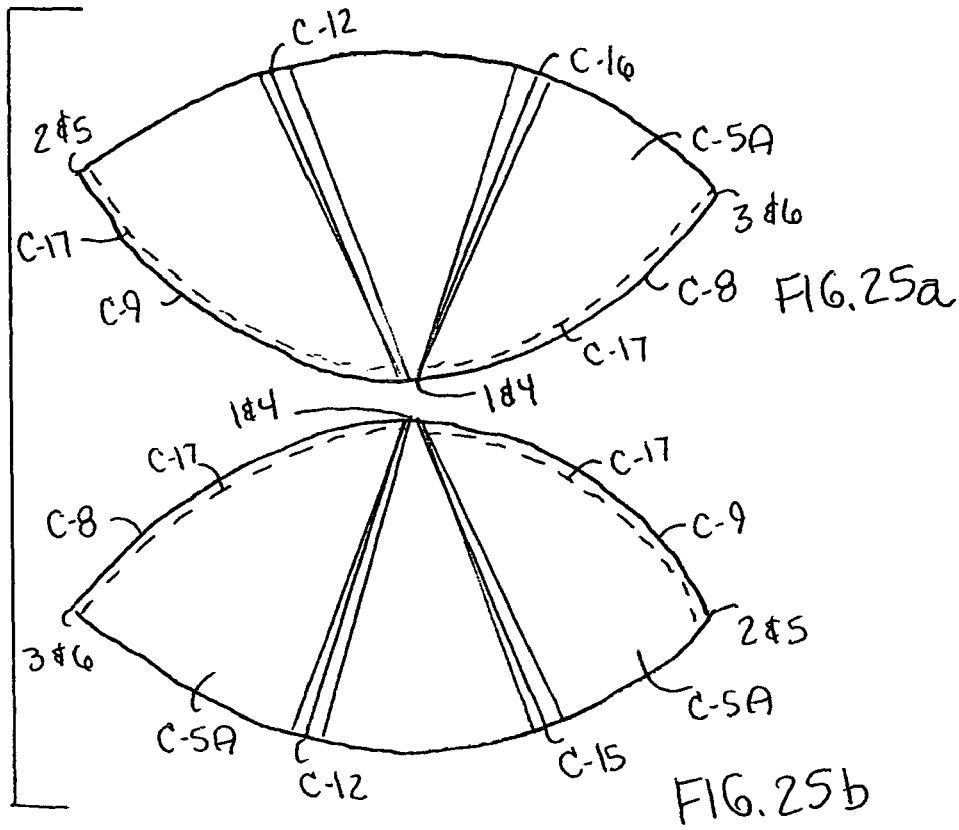
FIG. 25a
FIG. 25b
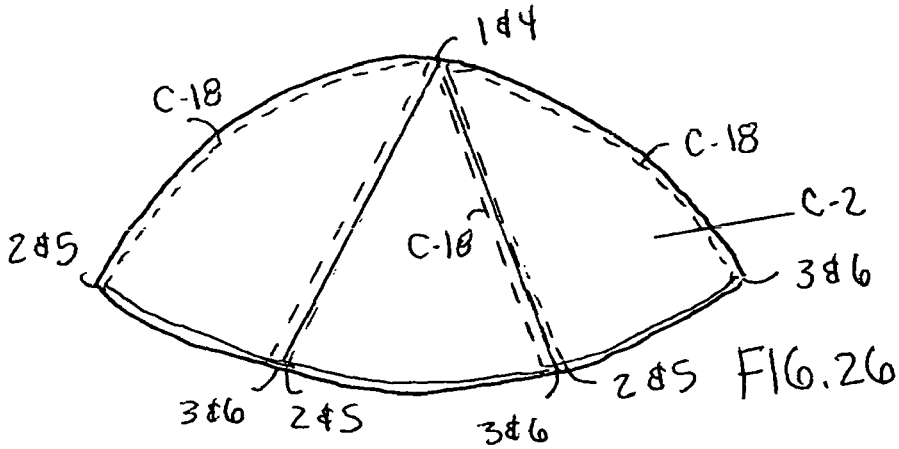
FIG. 26

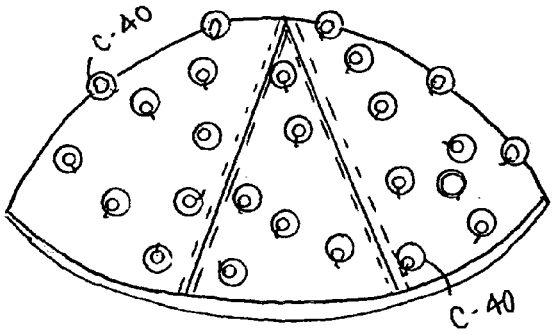
FIG. 27
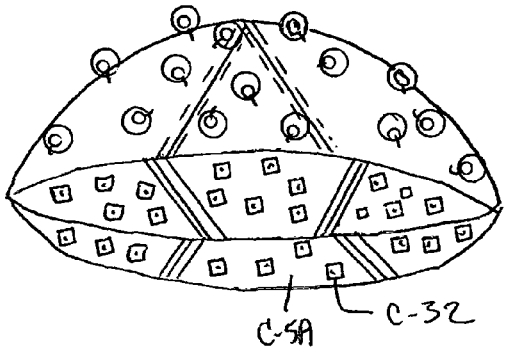
FIG. 28
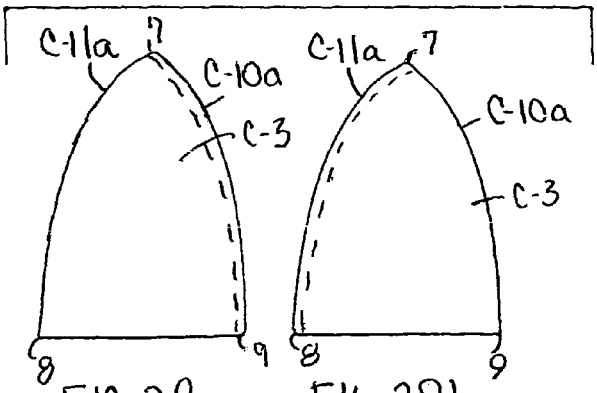
FIG. 29a
FIG. 29b
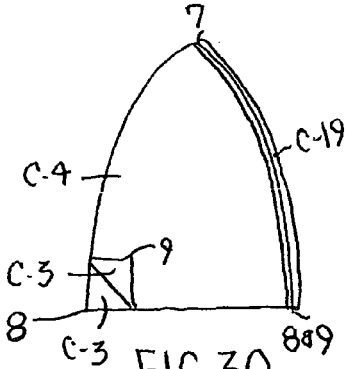
FIG. 30

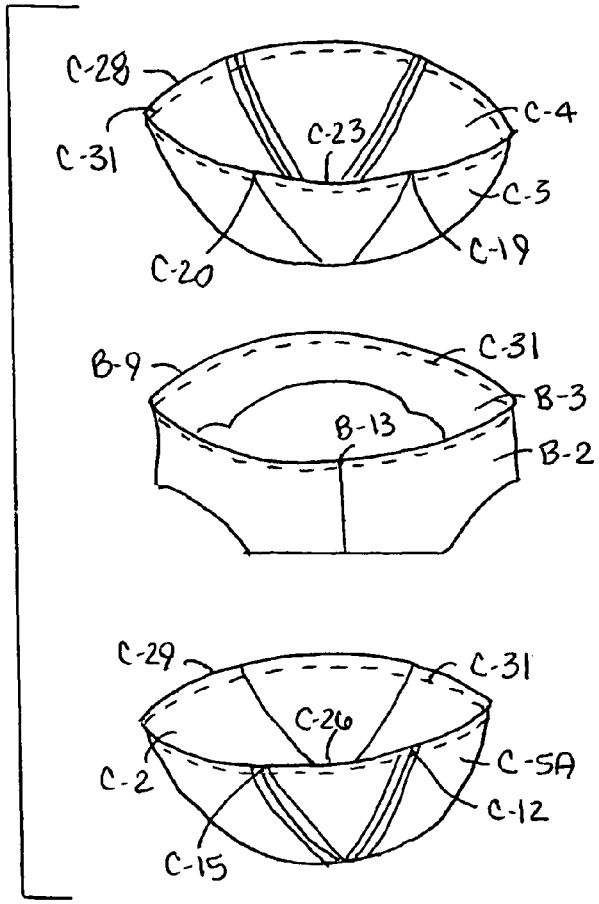
FIG. 35a
FIG. 35b
FIG. 35c
FIG. 36a
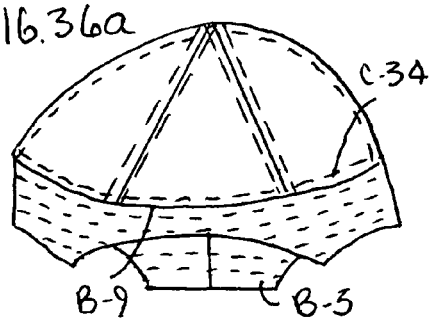
FIG. 36b
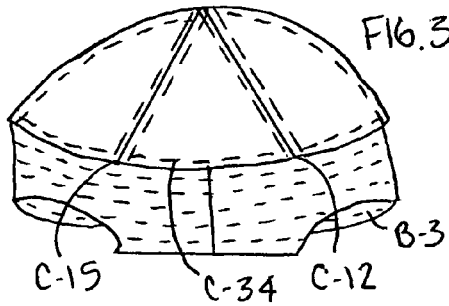

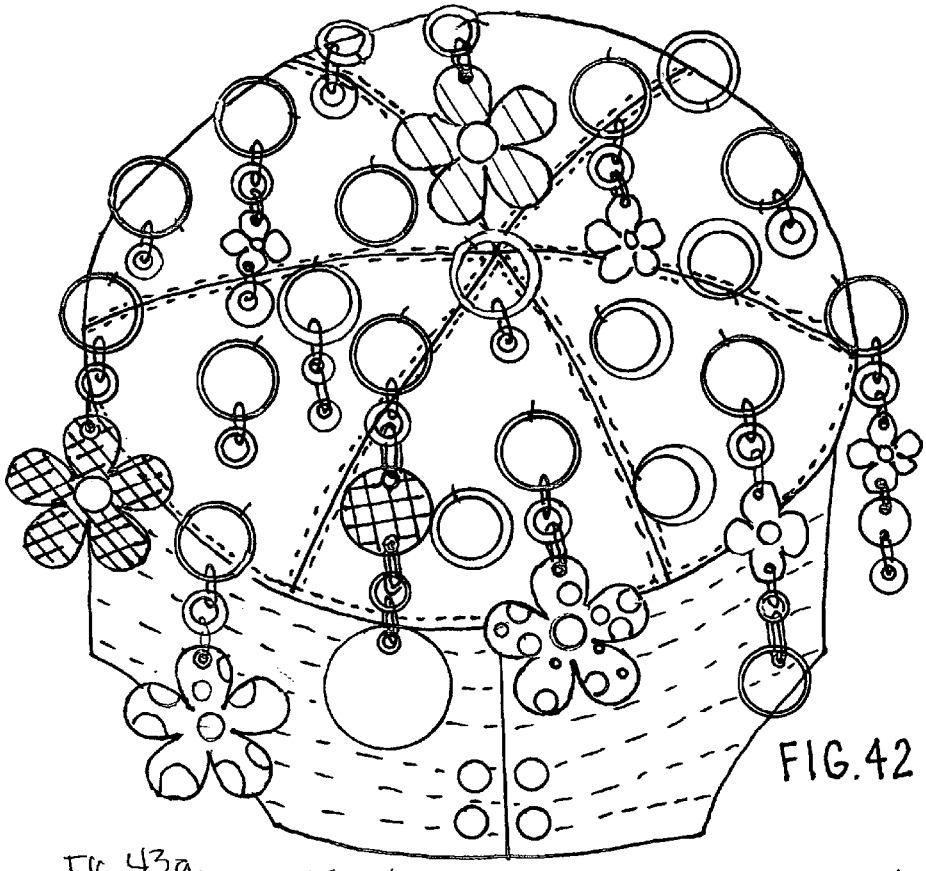
FIG. 42
FIG. 43a
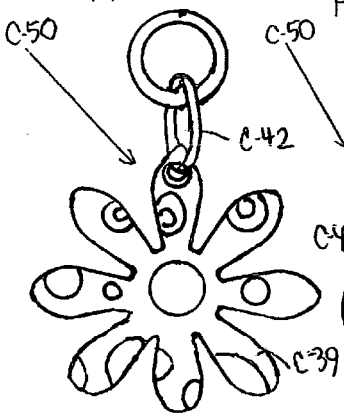
FIG. 43b
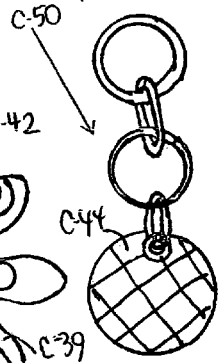
FIG. 43c
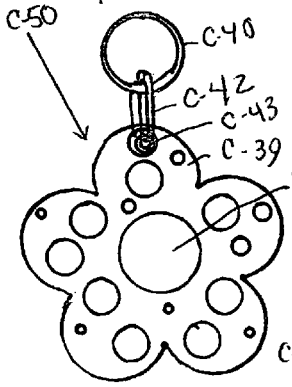
FIG. 43d
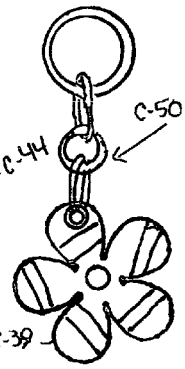

FIG. 44a
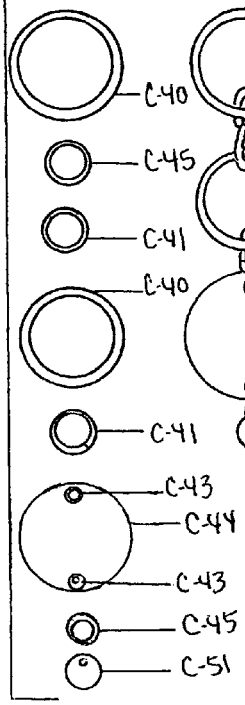
FIG. 44b
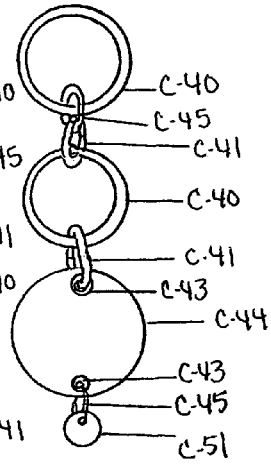
FIG. 45a
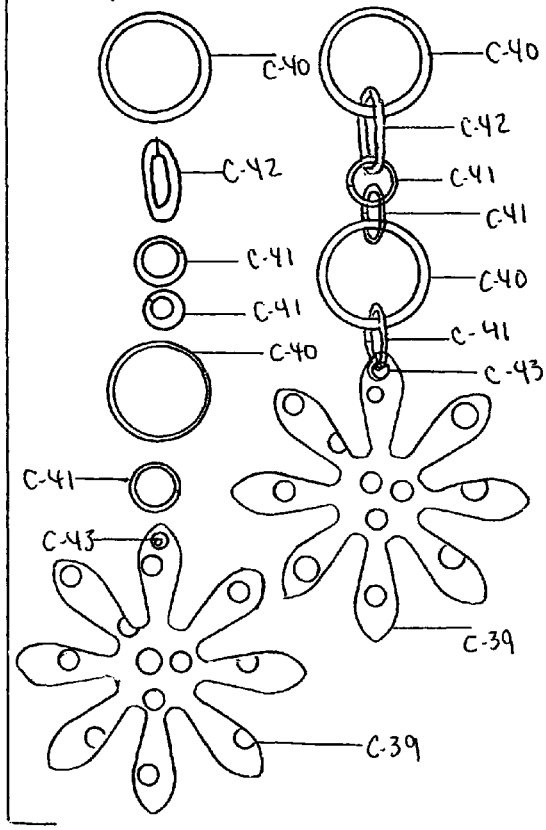
FIG. 45b
FIG. 46a
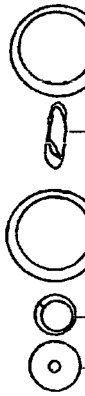
FIG. 46b
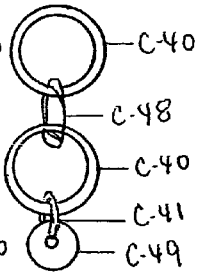
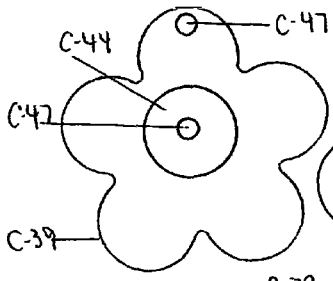
FIG. 47a
FIG. 47b
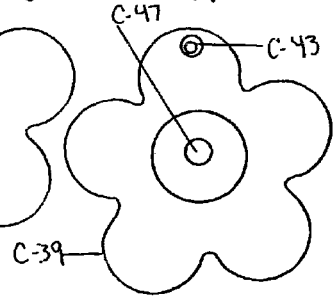

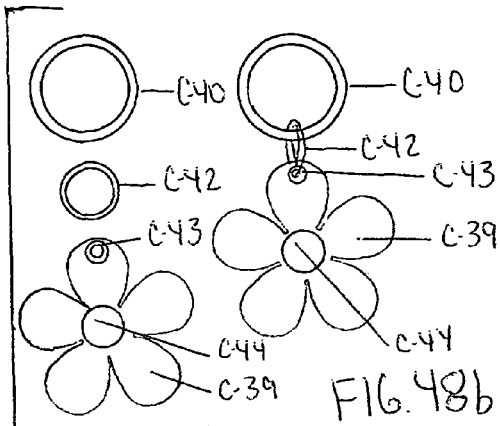
FIG. 48a
FIG. 48b
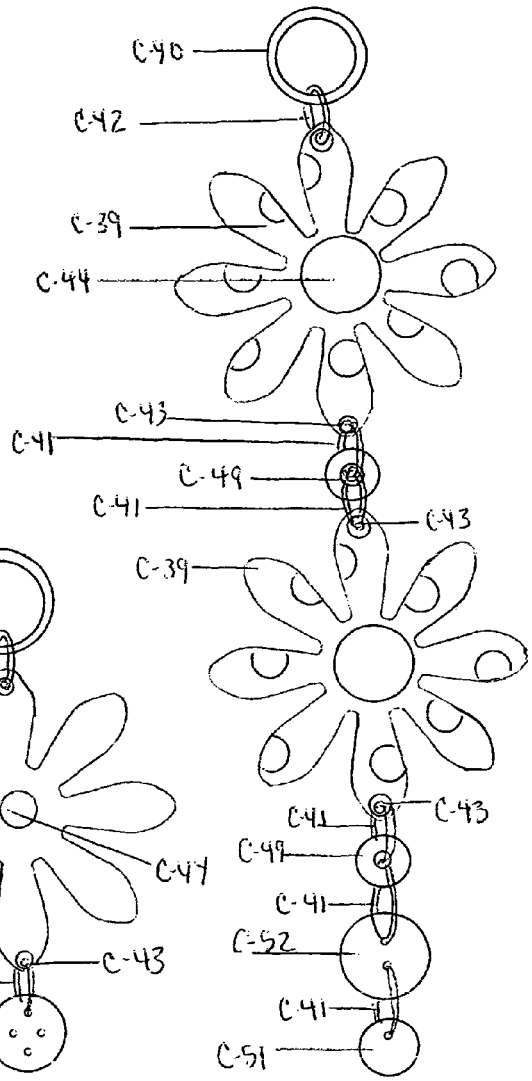
FIG. 50
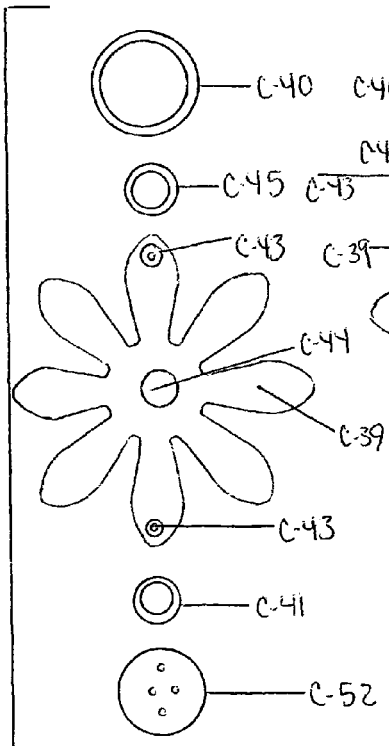
FIG. 49a
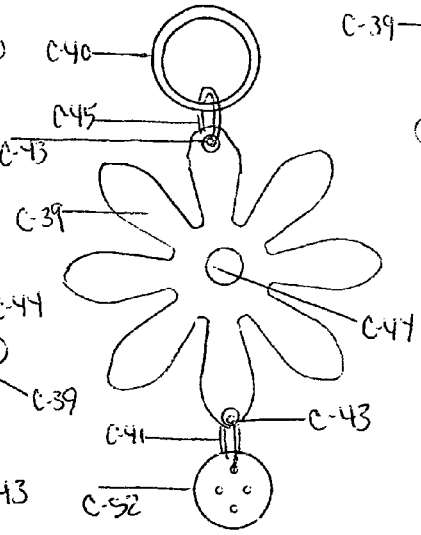
FIG. 49b

HEAD WEAR SPECIFICALLY BUT NOT EXCLUSIVELY FOR PEOPLE EXPERIENCING HAIR LOSS

CROSS-REFERENCE TO RELATED APPLICATIONS

Not applicable

FEDERALLY SPONSORED RESEARCH

Not applicable

SEQUENCE LISTING OR PROGRAM

Not applicable

BACKGROUND-FIELD

This application relates to head coverings, specifically but not exclusively artful head wear for people experiencing hair loss.

BACKGROUND-PRIOR ART

During hair loss, whether from illness or disease, not only does an individual have the hard battle of beating the illness, they have to endure the heartbreak of losing their hair. Lots of people feel that their hair is an extension of their identity, their self-expression.

The conventional head wear for hair loss has limited options. Scarves and bandanas are often unsuitable because of the fear of them slipping off the head or changing position. Scarves can be attractive but have the added burden of having to know the art of how to tie them correctly along with keeping them firmly secured in place. Knit hats can be expressive but can be itchy and hot. Wigs are offered but can be hot, itchy and usually not very attractive unless an expensive wig is obtained. Most head coverings are 'one size fits all', making it difficult to snugly fit each individual's head. Any head covering that has to cross over the ear in order be tied at the neck, impairs hearing. These head coverings are more securely fitted to the head, but are often uncomfortable, hot and restricting. Coverings that do not cross over the ear usually are difficult to keep firmly in place on the head and usually do not cover the entire hairline. In this day and age, some people opt to go bald in lieu of wearing a head covering that just does not feel like an expression of themselves. Many head coverings are simply utilitarian being void of anything flattering, artful, or interesting.

A known prior art includes a scarf disclosed in U.S. Pat. No. 5,083,318 (1992) to Hook.

Important advantages of the head wear include the quilted cap portion that gives added dimension and comfort to the head, the curved lower edge of the band that covers the hairline and is flattering to the face and yet allows the ear to be partially exposed so as to not impair with hearing, the easily donned aspect of the head wear and because of the curving of the lower edge of the band, the secure fit it provides. The head wear is fully lined to provide a soft fit to the scalp along with a finished look to the head covering. The snaps in the rear of the head covering allow for adjustment to different neck lengths. The beautiful and colorful fabrics that make up the head wear are stylish and fun to wear. The head wear is not 'one size fits all', it is made in different sizes to provide a better fit to each individual's head. The artful aspect of the head wear helps to give the wearer a feeling of wearing something creative rather than a purely utilitarian head cover. The versatility as far as expression and other advantages of one or more aspects will become apparent after considering the following description and accompanying drawings.

SUMMARY

In accordance with all three embodiments, a flattering, soft and comfortable head covering of beautiful fabrics that fits snugly on the head that is comprised of a cap and a band with the second and third embodiments having the cap supporting fasteners that in the third embodiment have artful adornments dangling from them, for added dimension, interest, fun, and enjoyment.

Advantages as stated in the BACKGROUND are that it offers a soft, comfortable, secure fit, a 'quilted' cap portion for added height, different sizes, easy to wear, hairline coverage and the opportunity for an outlet of self-expression to help compensate for one's lack of hair.

An object of these head coverings is to provide a practical yet attractive, comfortable, fun and interesting head wear for hair loss that will be so inviting that others will want to wear it thus alleviating some of the stigma of hair loss.

BRIEF DESCRIPTION OF DRAWING FIGURES

Drawings

Figures

Figure 5:
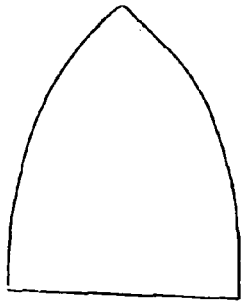
Figure 6:
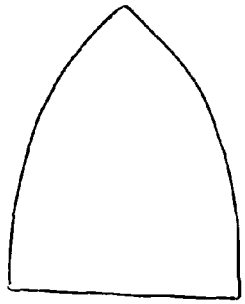
Figure 7:
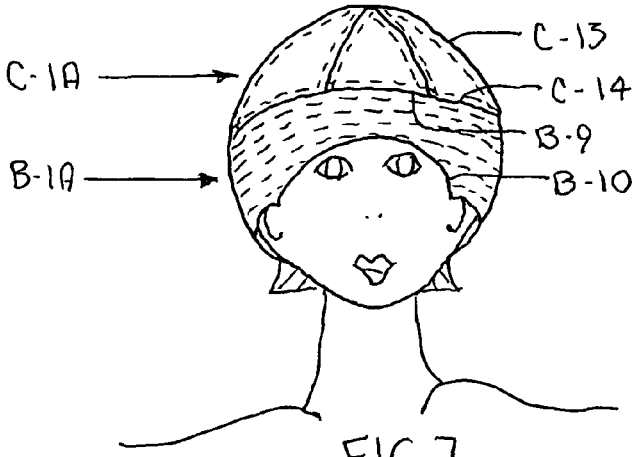

FIG. 5 shows basic pattern for cap portion of head wear for main fabric and quilt filler FIG. 6 shows basic pattern for cap portion of head wear for the lining FIG. 7 shows cap portion and band portion of Embodiment 1, front view, indicating straight and curved edge of band FIGS. 8, 9, 10, 11, 12, 13 and 14 show assembly of band portion of head wear FIG. 15 shows the completed band FIGS. 16, 17 and 18 show patterns used for assembling cap portion of the head wear FIGS. 19*a*, 19*b*, 20, 21*a*, 21*b*, 23, 24, 25*a* and 25*b* show assembly of main fabric and quilted fabric cap portion of head wear FIG. 26 shows completed main fabric and quilted portion of cap portion with finished stitching FIG. 27 shows addition of fasteners for Embodiment 2

FIG. 28 shows addition of felt squares for Embodiment 2

Figure 37:
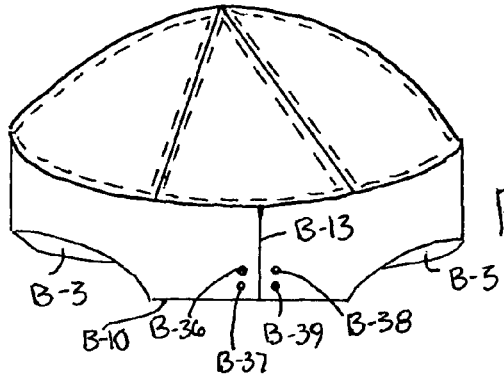
Figure 38:
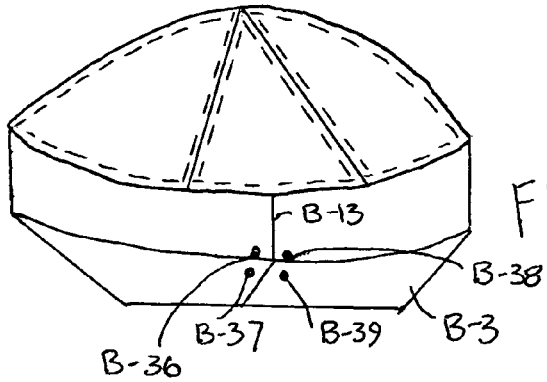
Figure 39:
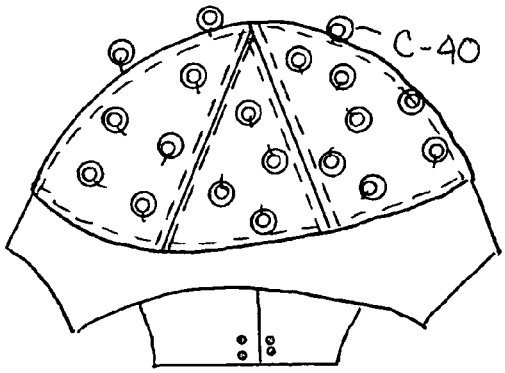
Figure 40:
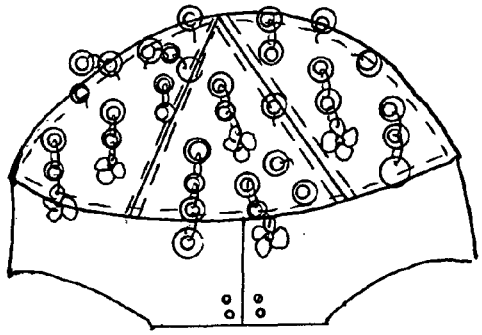
Figure 41:
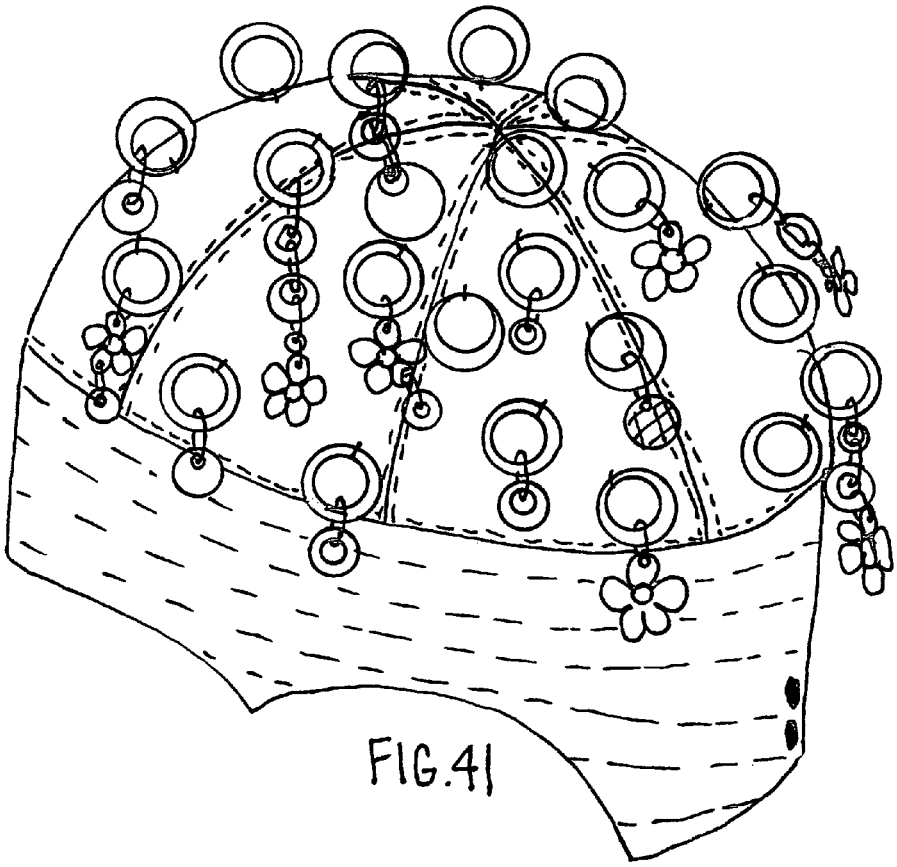

FIGS. 29*a*, 29*b*, 30, 31*a*, 31*b*, 33*a*, and 33*b* show assembly of lining portion of the cap FIGS. 35*a*, 35*b* and 35*c* show assembly of main fabric/quilted filler cap, lining cap and band FIGS. 36*a* and 36*b* show cap assembled and turned right-side out with finished stitching FIGS. 37 and 38 show snaps attached to rear of band FIG. 39 shows one example of a completed Embodiment 2, front view FIG. 40 shows one example of completed Embodiment 3, rear view FIG. 41 shows one example of an enlarged completed Embodiment 3, side view FIG. 42 shows one example of an enlarged completed Embodiment 3, rear view FIGS. 43*a*, 43*b*, 43*c* and 43*d* show possible examples of artful strands for Embodiment 3

FIGS. 44*a*, 44*b*, 45*a*, 45*b*, 46*a*, and 46*b* show make-up of possible art strands for Embodiment 3

FIGS. 47*a* and 47*b* show addition of eyelets to paper flowers

FIGS. 48*a*, 48*b*, 49*a*, 49*b* and 50 show examples of artful strands

FIRST EMBODIMENT see FIGS. 1, 4,5,6,7,8,9,10,11,12,13,14,15,16,17,18,19*a*, 19*b*,20,21*a*,21*b*,23, 24,25*a*,25*b*,26,29*a*,29*b*,30,31*a*,31*b*,33*a*, 33*b*,35*a*,35*b*,35*c*,36*a*,36*b*, 37 and 38

DETAILED DESCRIPTION

Figure 1:
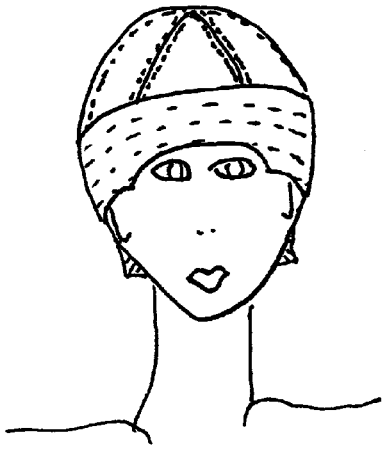
FIG. 1 shows front view of Embodiment 1
Figure 4:
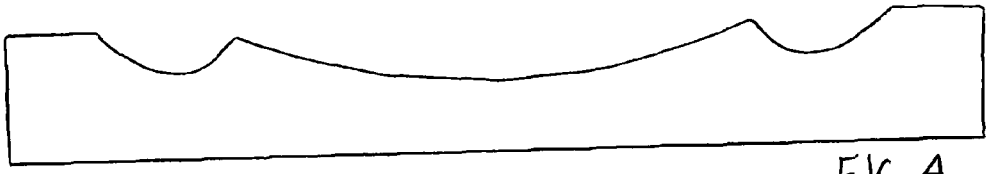
FIG. 4 shows basic pattern for band portion of head wear

One embodiment of the head wear is illustrated in FIG. 1, front view. This is the head wear in its simplest form comprised of a cap portion see FIG. 7, C-1A, and a band B-1A. The cap, C-1A has a curved upper crown, FIG. 7, C-13 with a straight lower edge C-14 with band B-1A having a straight upper edge see FIG. 7 B-9 with a curved lower edge B-10. Cap C-1A is comprised of 6 triangular pieces of fabric of equal size and shape, and band B-1A consisting of an elongated fabric strip. Both cap, C-1A and band, B-1A consist of three different fabrics. These two components, cap C-1A and band B-1A are attached by joining them together at their straight edges. Cap C-1A and band B-1A are constructed using 3 layers of cloth fabric; a main outer member fabric, a quilted filler fabric and a lining fabric. Although not shown here, these fabrics can be purchased at any fabric store. The fabrics can be of all different patterns, colors and compositions. Band B-1A and cap C-1A are made from 3 different patterns. FIG. 4 illustrates a basic pattern showing the shape for band B-1A. FIG. 5 shows a basic pattern for the main outer member fabric and the quilted fabric. FIG. 6 is an example of the shape of the basic pattern for the lining. The head wear can be made to any custom size. As seen in FIG. 1, FIG. 2 FIG. 3 and FIG. 7, band B-1A has a lower edge that is curved, B-10, FIG. 7. This edge fits across the lower brow, just above the eye, reaching just beyond the corner of the eye, where at the temple, curving slightly downward and towards the front of the face, to ensure hair line coverage, to the highest point of the cheekbone before curving, in an upwards arch, back towards the rear of the head transecting the ear mid-point, curving down, directly behind the ear to the bottom of the hairline, proceeding to rear of head still following and covering the hair line. Two snaps B36/B37 and B38/B39 as seen FIG. 37 and FIG. 38 are installed at the bottom center rear of the band. Detailed description will follow.

Construction of the Band see FIGS. 4, 7, 8, 9, 10, 11, 12, 13, 14, and 15

Band, B-1A is comprised of the main outer member fabric, referred to as main fabric, B1/B2 that has a 'wrong' inner side B-1 and a 'good' outer side B-2, quilted filler fabric, B-5/B-5A where both sides look the same thus one side is referred to as side 1, B-5 with the other side referred to as side 2, B-5A and lining B-3/B-4 with 'good' side being outer side B-3 and 'wrong' side B-4 being inner side.

Figure 8:
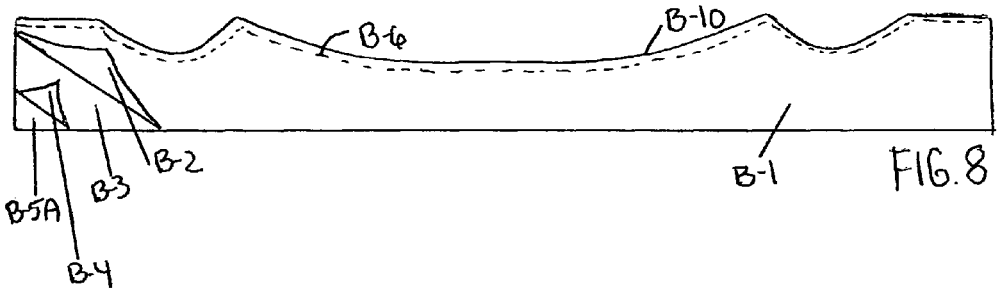
Figure 9:
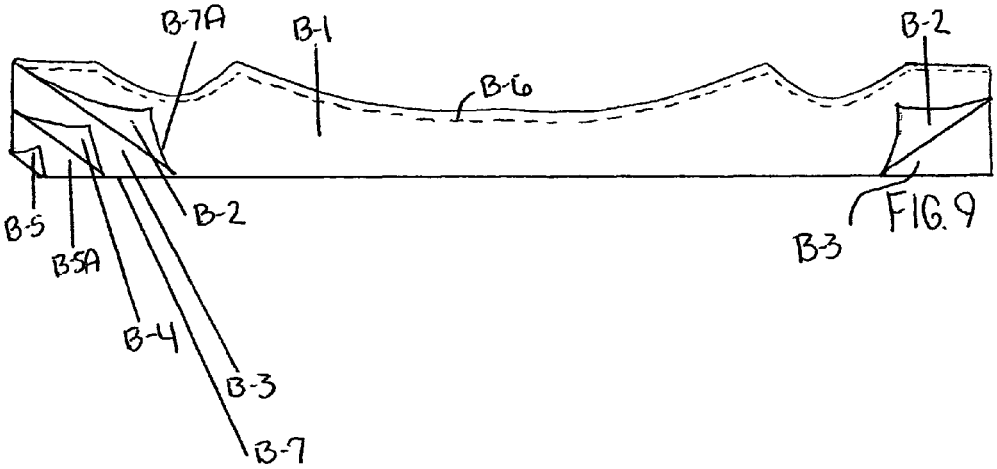
Figure 10:
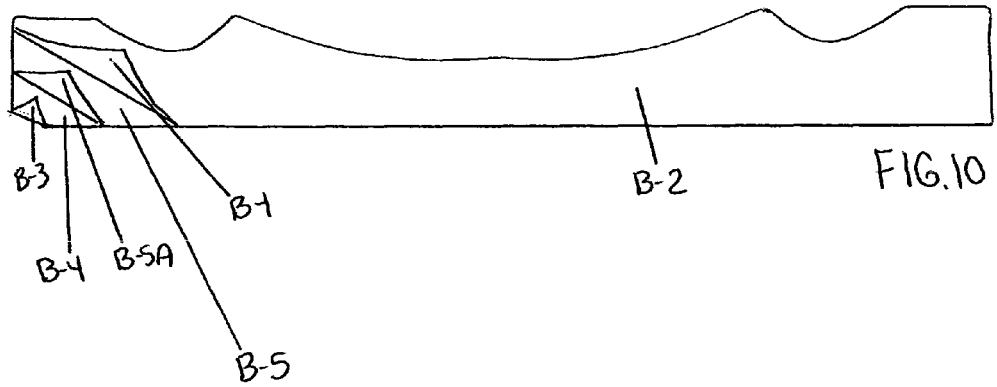
Figure 11:
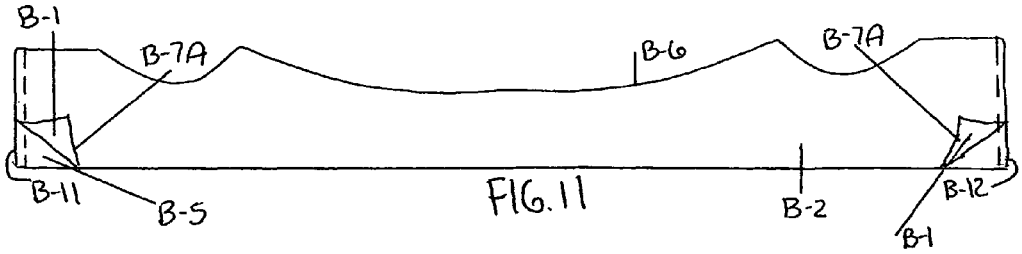

Band B-1A as shown in FIG. 7, is constructed 1$^{st}$. Cut pattern pieces for band B-1A out of main fabric B-1/B-2, quilted filler fabric B-5/B-5A and lining fabric B-3/B-4 using a pattern shape shown in FIG. 4. FIG. 8 shows placement of fabrics. First, quilted fabric side 2, B-5A is facing up, then wrong side of lining B-4 faces quilted fabric B-5A, with good side of main fabric B-2 facing good side of lining B-3, ending up with wrong side of main fabric B-1 facing up. As shown in FIG. 8, a ⅜" seam B-6 is sewn using a sewing machine, not shown here, along curved edge B-10, dotted line indicates sewing. This section gets turned inside out as shown in FIG. 9 and FIG. 10. Take the straight edge B-7A of main fabric B-1/B-2 and lift edge B-7A up over seam B-6 folding it down to the other straight edge B-7 of quilting and lining with wrong side of main fabric B-1 facing side 1 of quilting filler B-5. FIG. 10 shows band right-side out with proper placement of fabric. Good side of lining B-3 faces down, wrong side of lining B-4 faces side 2 of quilting B-5A, side 1 of quilting B-5 faces wrong side of main fabric B-1 with good side of main fabric B-2 on top. Iron the finished seam B-6.

Figure 12:
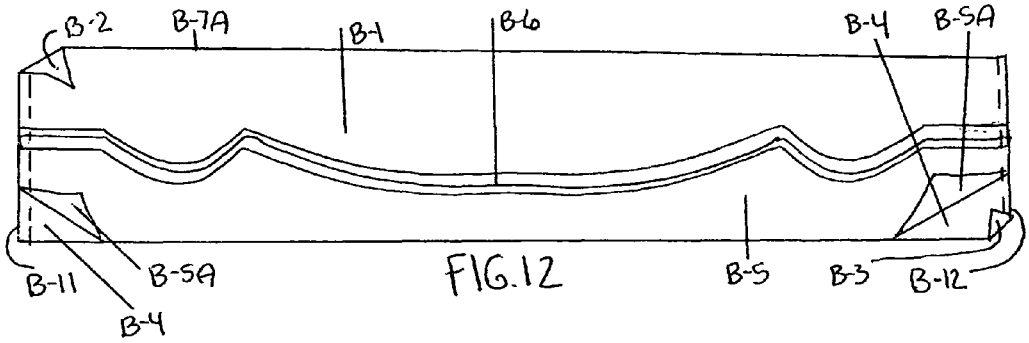
Figure 13:
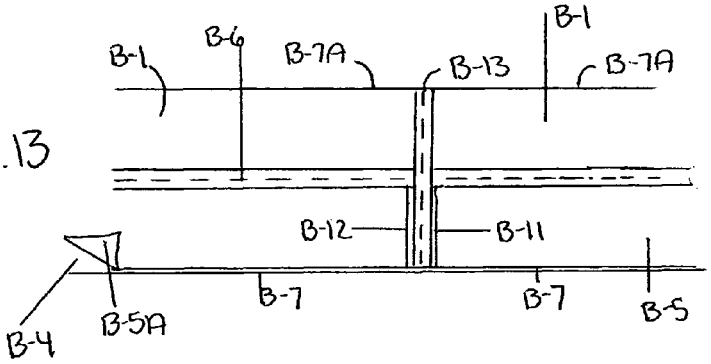
Figure 14:
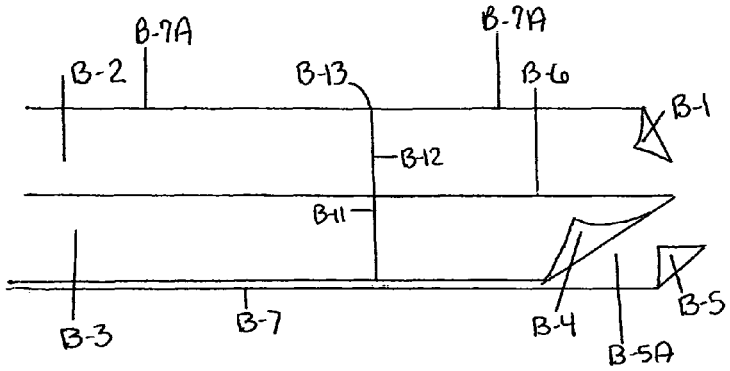

Both sides B-11 and B-12 of band will now be connected to form a circle. See FIGS. 11 thru 15. Take straight edge B-7A of main fabric in FIG. 11 and draw it straight up. As shown in FIG. 12, side 1 of quilting B-5 and wrong side of main fabric B-1 are facing up. Connect left side B-11 to right side B-12 facing good sides of main fabric B-2 together and facing good sides of lining B-3 together. As shown in FIG. 13, sew a ⅜" seam B-13, dotted line indicates sewing. Iron this seam. Flip the band over so that the good side B-2 of main fabric and good side B-3 of lining are facing up. The band is now going to be folded in half. As shown in FIG. 14, take straight edge B-7A of main fabric B-1/B-2 and fold it down to meet straight edge B-7 of quilting and lining folding at seam B-6. Wrong side of main fabric B-1 and side 1 of quilting fabric B-5, are facing each other. As shown in FIG. 15, the band is now a circle. The band gets finished stitched B-16, every ¼", dotted lines indicate sewing. This stitching B-16 runs parallel to straight edge B-9, which is the straight edge made up of all 3 fabrics, starting ¼" down from straight edge B-9 and ending at curved edge B-10.

Construction of the Cap, Main Fabric/Quilting Section see FIGS. 5, 7, 16, 17, 19*a*, 19*b*,20, 21*a*,21*b*,23,24,25*a*, 25*b* and 26

The main fabric and quilted portion of the cap is now constructed.

Main fabric C-1/C2 and quilted fabric C-5/C-5A portion of cap C-1A as shown in FIG. 7 is constructed next. Cut out 6 pieces each of main fabric C-1/C-2 and quilted filler fabric C-5/C-5A using pattern shapes shown in FIG. 5. FIG. 16 shows a pattern for main fabric C-1/C-2 with 1 being a top point of the pattern, 2 being a lower left point and 3 being a lower right point. Good side C-2 is facing up with a left side C-7 and a right side C-6. FIG. 17 shows a pattern for quilting fabric C-5/C-5A with side 1, C-5 facing up. Top point of the pattern is 4 with a lower left point 5 and a lower right point 6. A left side is indicated as C-9*a* and a right side indicated as C-8*a*. Place each piece of main fabric C-1/C-2 with good side C-2 up on top of each piece of quilting C-5/C-5A, side 1C-5 up. As shown in FIG. 19*a* and FIG. 19*b*, match up points 1, 2 & 3 in FIG. 16 with the corresponding points 4, 5 & 6 in FIG. 17. Left side C-7 FIG. 16 of main fabric C-1/C-2 matches up with left side C-9*a* FIG. 17 of quilting fabric C-5/C-5A and right side C-6 FIG. 16 of main fabric C-1/C-2 lines up with right side C-8*a* FIG. 17 of quilting C-5/C-5A. As shown in FIG. 19*a*, FIG. 19*b* and FIG. 20, two sections consisting of two pieces each are now to be sewn together. Place right section FIG. 19*b* on top of left section FIG. 19*a*, facing the good sides C-2 of main fabrics C-1/C-2 together and lining up points 1& 4 on the left section in FIG. 19*a* with points 1 & 4 on the right section in FIG. 19*b*. Match up left section FIG. 19*a* side C-7 with right section FIG. 19*b* side C-6 and left section FIG. 19*a* side C-6 with right section, FIG. 9*b* side C-7. Points 2 & 5 on left section FIG. 19*a* should line up with points 3& 6 on right section FIG. 19*b*. Points 3 & 6 on left section FIG. 19*a* should match up with points 2 & 5 on right section FIG. 19*b*. Everything must line up since sizing is exact. As shown in FIG. 19*a*, FIG. 19*b* and FIG. 20, sew a ⅜" seam C-12 starting at points 1&4 and ending at points 3&6 on left section FIG. 19*a* and points 2&5 on right section 19*b*, dotted lines indicate sewing. As shown in FIG. 20, with good sides C-2 of main fabric C-1/C-2 folded together, with quilted fabric C-5/C-5A side 2, C-5A on top, fabrics are; quilted fabric C-5/C-5A, side 1, C-5 touching wrong side C-1 of main fabric C-1/C-1/C-2, good side C-2 of main fabric C-1/C-2 C-2 touching good side C-2 of main fabric C-1/C-2 with wrong side C-1 of main fabric C-1/C-2 touching quilting fabric C-5/C-5A, side 1 C-5 with quilted fabric C-5/C-5A, side 2 C-5A facing up. FIG. 21*a* shows this section opened, with quilted fabric C-5/C-5A, side 2 C-5A facing up. Repeat this process. Two separate sections now exist, each consisting of 2 sections each comprised of 1 layer of main fabric C-1/C-2 and 1 layer of quilting fabric C-5/C-5A as shown in FIG. 21*a*. The two remaining single pattern pieces consisting of a layer of main fabric C-1/C-2 and a layer of quilting C-5/C-5A are sewn individually to the previously created sections. FIG. 21*a* and FIG. 21*b* will be used to show this repeated process. Important to note that the sides C-9*a* and C-8*a* of quilt fabric C-5/C-5A are now switched since the opposite side of quilting fabric C-5/C-5A, side 2, C-5A, is now on top. The left side will now be referred to as C-8 with the right side being referred to as C-9. Using FIG. 21*a* and FIG. 21*b* as a guide, line up left side C-8 as seen in FIG. 21*b* of one of the remaining single pattern pieces, with the right side C-9, FIG. 21*a*. Line up the pieces, making sure points 1&4 match on both sections and lower corner points 2&5 in FIG. 21*a* match up with points 3 & 6 in FIG. 21*b*. Main fabric C-1/C-2 good sides C-2 face each other. Sew a ⅜" seam C-15 from points 1&4 to points 2&5 and 3&6 just noted, dotted line indicates sewing. All edges must meet to make exact size. Refer to FIG. 23 for completed assembly. Repeat this process with remaining sections, lining up right side, C-9 FIG. 21*b* to left side, C-8 FIG. 21*a*. Line up points 1& 4 in FIGS. 21*a* to 1&4 in FIG. 21*b*. Line up points 2&5 in FIG. 21*b* to points 3&6 in FIG. 21*a* with main fabric C-1/C-2 good sides C-2 facing each other. Sew a 3/8" seam C-16 from points 1&4 to points 3&6 and 2&5 just previously noted, dotted line indicates seam. Refer to FIG. 24 for completed assembly. These two completed section are now sewn together. Refer to FIG. 25*a* and FIG. 25*b* for assembly. With main fabric C-1/C-2 good sides C-2 facing each other, line up the 2 three-pieced sections. Points 1&4 on both sections must meet. Points 3&6 in FIG. 25*b* must line up with points 2&5 in FIG. 25*a*. Points 2&5 in FIG. 25*b* must line up with 3&6 in FIG. 25*a*. Left side C-8 in FIG. 25*b* must line up with right side C-9 in FIG. 25*a* and right side C-9 FIG. 25*b* must line up with left side C-8 FIG. 25*a*. A ⅜" seam C-17 is sewn starting at points 3&6 in FIG. 25*b* and points 2&5 in FIG. 25*a* following the curve of the cap, through points 1&4 down the other side to points 3&6 in FIG. 25*a* and points 2&5 in FIG. 25*b* dotted line indicates sewing. Turn cap right side out as shown in FIG. 26. A line of stitching C-18 is sewn through both the main fabric C-1/C-2 and the quilted fabric C-5/C-5A running along all seams ⅛" from edge of seams, dotted lines indicate sewing. This is where the fasteners C-40 seen in FIG. 27 are added to the head wear in the 2$^{nd}$ and 3$^{rd}$ embodiments.

Construction of Cap, Lining Portion see FIGS. 6, 18, 29*a*, 29*b*, 30, 31*a*, 31*b*, 33*a* and 33*b*

Figure 31A:
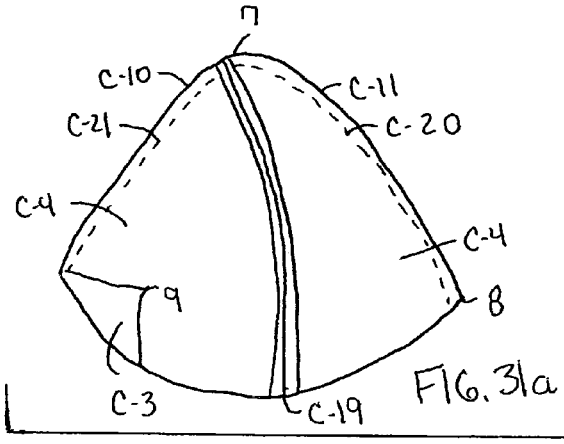
Figure 31B:
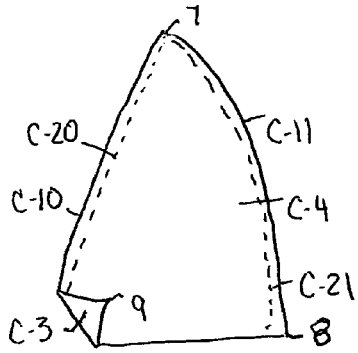
Figure 33A:
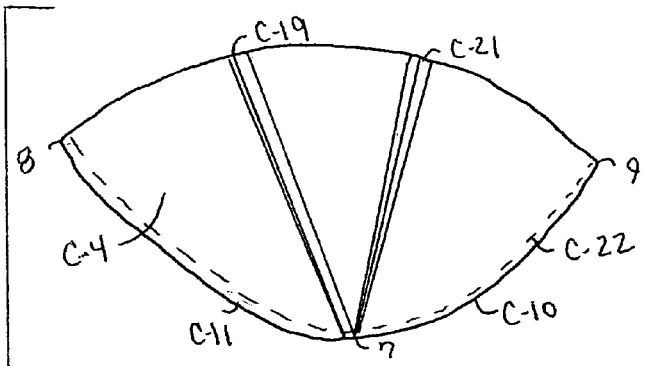
Figure 33B:
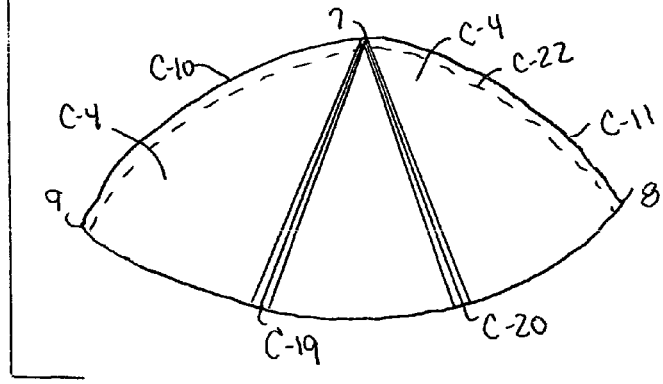

The lining portion of cap C-1A is now created. Using the pattern shape shown in FIG. 6, cut out 6 pieces of lining fabric, C-3/C-4. As shown in FIGS. 29*a* and 29*b*, the 2 pieces of lining are to be sewn together. With good sides C-3 of lining fabric C-3/C-4 facing each other, line up point 7 in FIG. 29*a* to point 7 in FIG. 29*b*. Line up lower right point 9 FIG. 29*a* with lower left point 8 FIG. 29*b* and line up lower left point 8 FIG. 29*a* with lower right point 9 FIG. 29*b*. Good sides C-3 of lining face each other. Line up left side C-11*a* FIG. 29*a* with right side C-10*a* FIG. 29*b*, line up right side C-10*a* FIG. 29*a* with left side C-11*a* FIG. 29*b*. Making sure all edges meet exactly, sew a ⅜" seam C-19, as shown in FIG. 30, from point 7 to point 8 as shown in FIG. 29*b* and from point 7 to point 9 as shown in FIG. 29*a*, dotted line indicates sewing. Repeat this process. The same procedure is used as when sewing the main fabric C-1/C-2 and quilted fabric C-5/C-5A sections together. Important to note that the left C-11*a* and right C-10*a* sides are switched since the wrong side, C4 of the lining is now facing up. The left side is now referred top as C-10 and the right side is C-11. The two sections just sewn together consisting of two pieces each are sewn individually to the two remaining single pieces. As shown in FIG. 31*a* and FIG. 31*b*, sew a ⅜" seam C-20 from points 7 on both sections to point 8 in FIG. 31*a* and point 9 in FIG. 31*b* making sure left side C-10 of FIG. 31*b* is lined up with right side C-11 of FIG. 31*a*, with good sides C-3 facing each other. Dotted line indicates sewing. See FIG. 33*b* for the completed piece. Repeat this process for the remaining single piece of lining, C-3/C-4. Line up the two top points 7, making sure lower left point 9 on two section piece FIG. 31*a* is lined up with lower right point 8 on the single piece FIG. 31*b*, making sure left side C-10 of FIG. 31*a* matches up with right side C-11 of FIG. 31*b*. Sew a ⅜" seam C-21 from points 7 to 9 in FIG. 31*a* and from points 7 to 8 in FIG. 31*b* with good side C-3 of lining C-3/C-4 facing each other. Dotted line indicates sewing. See FIG. 33*a* for completed section. The two three-pieced sections are sewn together as shown in FIG. 33*a* and FIG. 33*b*. With good sides C-3 of lining C-31C-4 facing each other, line up the top point 7, of both sections as seen in FIG. 33*a* and FIG. 33*b*. Line up lower left side point 9 of the section in FIG. 33*b* with lower right side point 8 of the section in FIG. 33*a*, making sure side C-10 FIG. 33*b* matches side C-11 FIG. 33*a*. Line up the lower right side point 8 in FIG. 33*b* with lower left point 9 as shown in FIG. 33*a*, making sure side C-11 FIG. 33*b* lines up with side C-10 FIG. 33*a*. All edges must meet since sizing is exact. Sew ⅜" seam C-22 starting at Point 9 FIG. 33*b* and point 8 FIG. 33*a* following the curve to points 7 FIG. 33*a* & FIG. 33*b* and following the curve down the other side to points 8 FIGS. 33*b* and 9 FIG. 33*a*, dotted line indicates sewing.

Assembly of Cap and Band see FIGS. 35*a*, 35*b* and 35*c*

All three sections are to be assembled as shown in FIG. 35*a*, FIG. 35*b* and FIG. 35*c*. Begin with cap section that is made up of main fabric C-1/C-2 and quilting fabric C-5/C-5A with quilting fabric side 2, C-5A facing outward, FIG. 35*c*. The good side C-2 of the main fabric C-1/C-2 is facing outward on the inside as seen in FIG. 35*c*. As shown in FIG. 35*b* the band gets placed inside main fabric C-1/C-2 and quilted fabric C-5/C-5A cap, with good side B-2 of main fabric B-1/B-2 of band facing good side C-2 of cap as seen in FIG. 35*c* and FIG. 35*b*. Lining cap section, as shown in FIG. 35*a*, is placed inside band with good side B-3 of lining fabric B-3/B-4 of the band facing good side C-3 of lining fabric C/3/C-4 of lining cap. The straight edges of all three, C-29 FIG. 35*c* on main fabric/quilted cap section, B-9 FIG. 35*b* on band and C-28 FIG. 35*a* on lining cap section must all meet exactly. Position all three sections so that rear seam B-13 FIG. 35*b* of band meets a center point C-26 FIG. 35*c* of main fabric/quilted section which is ½ way between seams C15 and C-12 and the center point C-23 FIG. 35*a* ½ way between seam C-20 and seam C-19 on lining cap section. Sew ½"

seam C-31 FIGS. 35*a*, 35*b* and 35*c*, sewing all three section together, starting at seam C-15 FIG. 35*c* on main fabric/quilted section, following the straight line of the edges C-29 FIG. 35*c*, B-9 FIG. 35*b* and C-28 FIG. 35*a*, going in a clockwise direction, until you reach seam C-12 FIG. 35*c* on main fabric/quilted section as seen in FIG. 35*c*, dotted line indicates sewing. Turn cap right side-out by pulling the inner cap material through the area that was not sewn which is located between seams C-15 and C-12 as seen in FIG. 35*c*. As shown in FIG. 36*a* and FIG. 36*b*, a finishing seam C-34 is sewn through all three layers of fabric. First, make sure lining is firmly up inside cap, Stitch ⅛" away from seam C-31 that was created when sewing all three sections together, see FIGS. 35*a*, 35*b*, 35C. Start at seam C-15 as seen in FIG. 36*b* continue sewing clockwise around the circumference until you come to where the section between seam C-15 and seam C-12 FIG. 35*c* was left open to pull the fabric through. Refer to FIG. 36*b*. Carefully sew section shut between seams C-12 and C-15, making sure not to have any of the lining fabric C/3/C-4 in the way of your stitching C-34. The stitching has come to your beginning starting point, at seam C-15. As shown in FIG. 37 and FIG. 38, two snaps, B-36/B-37 and B-38/B-39 are installed. These snaps are installed using a snap attaching tool that can be purchased at a fabric store or a snap attaching machine that can be purchased from a company that sells a commercial grade snap fastener machine. The left snap B-36/B-37 has a top B-36 and a bottom B-37. The right snap B-38/B-39 has a top B-38 and a bottom B-39. Using a snap attaching tool attach top part B-36 of left snap B-36/B-37, 2" above bottom edge B-10 of band B-1A and ½" to the left of seam B-13. Attach bottom part B-37 of left snap B-36/B-37 ½" from bottom edge B-10 of band B-1A and ½" to the left of seam B-13. Attach top part B-38 of right snap B-38/B-39 2" above bottom edge B-10 of band B-1A and ½" to the right of seam B-13. Attach bottom part B-39 of right snap B-38/B-39 ½" to the right of seam B-13 and ½" from bottom edge B-10 of band B-1A.

Operation

The head wear consists of an upper portion that contains cap C-1A and a lower portion that contains band B-1A as shown in FIG. 7. The cap C-1A is made up of 6 sections that form the cap portion of the head wear. Cap C-1A is the curved upper edge C-13, FIG. 7 of the head wear that offers a firm and comfortable fit to the head. Like band B-1A, FIG. 7, cap C-1A, is made up of 3 different materials, main member outer fabric or main fabric C-1/C-2 for cap, B-1/B-2 for band, quilted filler fabric C-5, side 1/C-5A, side 2 for cap, B-5, side 1/B-5A, side 2 for band and lining C-3/C-4 for cap, B-3/B-4 for band. The quilted filler provides a soft and comfortable fit to the scalp along with adding structure and dimension to the shape of the head. The outer fabric will be of such a beautiful nature that it will provide eye appeal. The lining provides a soft fit to the head along with giving a finished look. The band B-10, FIG. 7 is what keeps the head wear firmly on the head. Lower curved edge B-10 of band B-1A fits low across the forehead and follows a pathway across the forehead in the space just above the lower brow. Upon reaching the corner of the eye at the temple, the band curves slightly downward and slightly towards the front of the face to the uppermost point of the cheekbone, framing the face in a flattering manner, before it curves in an upward arch back towards the rear of the head transecting the ear at mid-point, so as not to interfere with the wearer's hearing, where just behind the ear the edge curves downwardly towards the bottom of the hair line continuing to the rear of the head, covering the hairline where the band converges with the opposite end of the band that encircled the head on the other side, see FIG. 1, FIG. 2 and FIG. 3. The two snaps B-36/B-37 and B-38/B-39 as shown in FIG. 37 and FIG. 38 are installed on either side of the seam B-13, FIG. 37 and FIG. 38 of band B-1A, FIG. 7 for adjustment to the band for neck length. The lower portion of the snaps B-37 and B-39 are attached to the top portion of the snaps B-36 and B-38 to allow for this adjustment.

Thus because this headwear offers a soft, secure and comfortable fit to the head without impairment to hearing along with a flattering fashionable fun look, this head covering offers desirability over prior art.

SECOND EMBODIMENT

FIGS. 1,2 and 4, 5, 6,7,8,9,10,11, 12,13,14,15,16, 17, 18, 19*a*, 19*b*, 20, 21*a*,21*b*,23,24,25*a*,25*b*,26,27,28,29*a*,29*b*,30, 31*a*,31*b*,33*a*,33*b*,35*a*, 35*b*, 35*c*, 36*a*, 36*b*,37,38 and 39

Second embodiment is created just as the first embodiment except that the step of attaching fasteners to the exterior of the cap portion is added. This is done after completion of main fabric and quilted cap section, see FIGS. 26, 27 and 28

Addition of Fasteners

Figure 2:
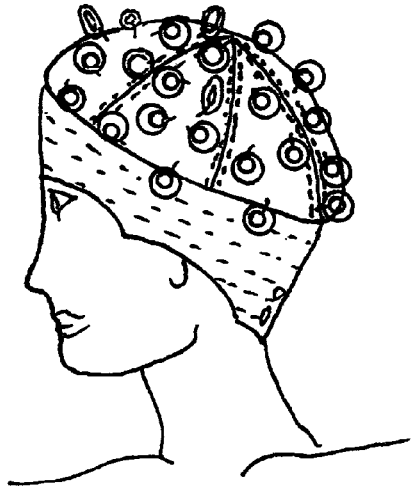
FIG. 2 shows side view of Embodiment 2
Figure 3:
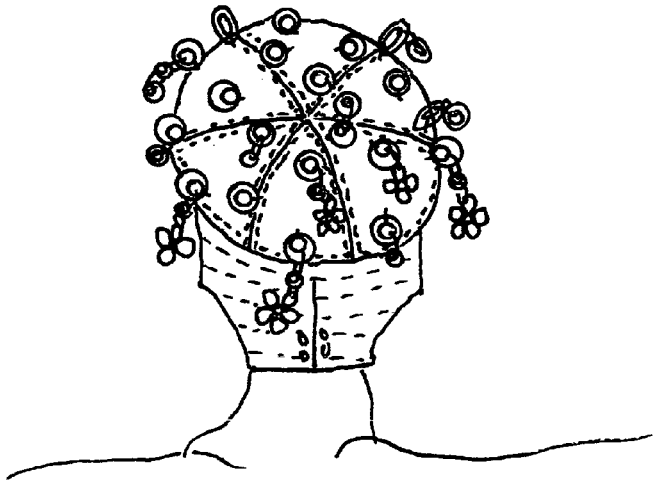
FIG. 3 shows rear view of Embodiment 3

In the $2^{nd}$ Embodiment, see FIG. 2 there are fasteners C-40, as shown in FIG. 27 attached to cap C-1A FIG. 7 of the head wear. Fasteners C-40 shown, are plastic rings, 1" in diameter. These fasteners are not to be limited to just rings nor to just plastic fasteners nor to just a fastener with a 1" diameter. They can be of many different shapes and sizes and of different materials including but not limited to plastic, metal, wood and rubber, Fasteners C40, are sewn to cap C-1A by first attaching a felt square C-32 to quilted filler side 2,C-5A, as seen in FIG. 28, or a similar material that aids in anchoring fastener C-40. Felt square C-32 is about ⅜" square, and is attached when sewing fastener C-40 onto main fabric C-1/C-2 of cap C-1A. The number of fasteners that are attached can vary. After attaching fasteners C40, see FIGS. 27 and 28, continue on as in the first embodiment, starting with constructing the lining cap, see FIG. 29*a* through 39.

Operation

This section is the same as with the first embodiment noted above with the following addition.

Fasteners C-40, see FIG. 39 that are attached to cap C-1A, see FIG. 7 are for added interest and added dimension and height for the head. They are to add fun as well as serve a function for the third embodiment, to follow. The attachments as shown in FIGS. 43*a*,43*b*,43*c* and 43*d* discussed in the third embodiment are attached to the head wear by attaching them to these fasteners C-40, FIG. 39.

The advantages are the same as in the first embodiment with the addition of offering a higher level of artfulness and unique appeal. The fasteners also add a desired dimension and height to the head wear, see FIG. 2.

THIRD EMBODIMENT

FIGS. 1,2,3,4,5,6,7,8,9,10,11,12,13,14,1516,17,18,19*a*, 19*b*,20,21*a*, 21*b*,23,24,25*a*,25*b*,26,27,28,29*a*,29*b*,30,31*a*, 31*b*,33*a*,33*b*,35*a*,35*b*,35*c*,36*a*,36*b*,37,38,39,40,41,42, 43*a*, 43*b*,43*c*,43*d*,44*a*,44*b*,45*a*,45*b*,46*a*,46*b*,47*a*,47*b*,48*a*,48*b*, 49*a*,49*b* and 50

The third embodiment is created just as the second embodiment except in this version the artful strands C-50 as seen in FIGS. 43*a*, 43*b*, 43*c* and 43*d*, of objects and fasteners are added to whatever fasteners were used in the $2^{nd}$ embodiment see FIGS. 3, 40,41 and 42. These attachments are added following the completion of the $2^{nd}$ embodiment, see FIGS. 1 through 39.

The third embodiment is very artful. As shown in FIGS. 40 through 50, added artful strands C-50 of fasteners and objects, see FIGS. 43*a*, 43*b*, 43*c*,43*d*,44*a*,44*b*, 45*a*,45*b*, 46*a*,46*b*,48*a*, 48*b*,49*a*,49*b* and 50 are attached to some or all of the previously installed fasteners C-40 as shown in FIG. 27 and FIG. 39. Fasteners C-40, or similar methods of fastening, are used as anchors for the added strands of adornments. These attached pieces include but are not limited to two and three dimensional shapes comprised of scrap booking paper; heavy, beautifully decorated papers, decorated on both sides, further including beads, buttons and various objects comprised of metal, rubber, plastic, wood, vinyl, and glass ranging in size in most cases from ¼" to 3". Artful strands C-50 include various fasteners. As shown in FIG. 41 and FIG. 42, fasteners including rings of various materials including plastic C-40 as indicated in FIG. 44*a*, FIG. 44*b*, FIG. 45*a*, FIG. 45*b*, FIG. 46*a* and FIG. 46*b*, rubber C-49 as seen in FIG. 46*a* and FIG. 46*b*, and metal C-41 and C-45 as seen in FIG. 44*a*, FIG. 44*b* are used to interconnect other fasteners and objects to each other. These fasteners range in size, in most cases from ⅜" to 2½" in diameter. FIG. 41 illustrates a side view of the head wear with some artful strands attached to cap portion C-1A of the head wear. FIG. 42 shows a rear view of the strands comprised of fasteners C-40 and shapes C-39. For an illustration of some of the combinations possible see FIGS. 43*a*, 43*b*, 43*c*,43*d*, 44*a*,44*b*, along with FIGS. 45*a*, 45*b*,46*a*, 46*b*,48*a*, 48*b*, 49*a*, 49*b* and 50.

Artful strands as shown in FIG. 46*a* that contain washable materials are permanently attached to original fasteners. The strands, see FIG. 45*a*, that contain paper, or any materials that are not washable, can be detached from the original fastener C-40 by means of a split plastic ring C-42, a safety pin C-48, or similar methods that are readily opened for easy removal. As shown in FIG. 44*a* and FIG. 44*b*, start out with the original fastener which in this case is plastic ring C-40. A metal jump ring C-45, is opened with pliers, another jump ring C-45 or split ring C-41, is attached to 1$^{st}$ jump ring. The 1$^{st}$ jump ring is put through the plastic ring and closed, using the pliers. The 2$^{nd}$ ring is now attached to a plastic ring C-40, then closed. Another split ring C-41 is attached to the previous plastic ring C-40 and a circular shape C-44 made out of paper. This ring is closed. The paper shapes, which are stamped out of heavy paper using a paper punch, that can be purchased at any fabric or craft store, has an eyelet installed just within its outer edge. As shown in FIG. 47*a*, a hole C-47 is punched just inside the edge of a paper shape or any object that is going to be used that needs a hole for attachment purposes. A ⅛" eyelet C-43 FIG. 47*b* is installed into this shape using a metal punch and hammer. This eyelet helps to reinforce the hole in which the fastener is put through. Eyelets are not limited to just this size. In FIG. 47*b*, the shape shown is a paper flower C-39. This flower C-39 has a circular paper shape C-44 glued to its center as shown in FIG. 47*a*. A hole C-47 FIG. 47*a* is punched in the middle of this circular shape using a paper punch that can be purchased at a fabric or office supply store. These paper shapes are laminated or covered with acrylic sealant or other similar processes. Another example is shown in FIG. 46*a* and FIG. 46*b*. Starting out with the original fastener, in this case plastic ring C-40, a safety pin C-48 is attached to this original ring C-40 and another ring C-40. A split ring C-41 is added to the previous plastic ring and a rubber ring C-49. In FIG. 45*a* and FIG. 45*b*, the starting fastener is plastic ring C-40, then a plastic split ring C-42 is attached to the 1$^{st}$ plastic ring C-40, this split plastic ring C-42 is gently pulled open with the fingers in order to slip it onto the previous and proceeding fasteners. Then attach a split metal ring C-41 opening with a 'split' fastener tool, purchased at a fabric of craft store, that easily allows opening of the split metal ring C-41, attach another split ring C-41, using the same process followed by a plastic ring C-40. A metal split ring is next followed by a paper flower, C-39 that has an eyelet C-43 installed at the top. There are many different combinations of objects and fasteners that comprise the artful strands that are created in adorning the head wear in the manor noted above. It is the intent not to be limited to those fasteners and adornments specifically mentioned but to include other fasteners and objects that would be used in the same vein without departing from the spirit and scope of the head wear.

Operation

This section is the same as in the 2$^{nd}$ embodiment section with the following additions. The fasteners C-40, FIG. 27, that were attached in the second embodiment are now used for the support of the artful strands as shown in FIGS. 43*a*,43*b*, 43*c*,43*d*,44*a*,44*b*,45*a*,45*b*,46*a*,46*b*,48*a*, 48*b*, 49*a*, 49*b* and 50. The strands C-50, are attached to some or all of the fasteners C-40, FIG. 41 and FIG. 42. As shown in FIGS. 44*a*,44*b*,45*a*,45*b*,46*a* and 46*b*, 48*a*, 48*b*, 49*a*, 49*b*, 50 these strands are comprised of objects and fasteners. These objects further include paper flowers and other paper shapes, beads, and buttons. The materials the objects are comprised of include plastic, metal, rubber, glass, vinyl, wood and paper. These strands C-50 can be permanently attached or made to be detachable by using an easily opened fastener C-42 when attaching to the fastener C-40 already permanently attached to the cap. The objects and fasteners used are only limited to the imagination and to what size and weight the fasteners serving as anchors can support. These strands C-50 are to add creativity, interest, art, color and joy to the wearer and all who view the headwear.

The advantages are the same as in the 1$^{st}$ and 2$^{nd}$ embodiments with the addition of having the head covering serve as an even larger outlet for self-expression and creativity. The head coverings are beautiful, colorful, and fun to wear, bringing joy to all who wear and view them.

Conclusion, Ramifications, and Scope

Accordingly, the reader will see that the head wear of the various embodiments is a head covering that in all its embodiments, is quite attractive and comfortable to wear. The lower curve of the band helps the cap to stay securely on the head, is curved in such a manner as to allow the wearer to be able to hear while supplying an attractive frame to the face. The quilted filler adds coziness and structure to the headwear. The rear of the band, at the nape, can be adjusted for different neck lengths by simply flipping up the band and snapping. The beautiful fabrics are eye catching and stylish. The head covering is fully lined and structural. The 2$^{nd}$ embodiment, with the fasteners, adds dimension and interest to the head wear. The 3$^{rd}$ embodiment, with its added rings, various other fasteners and artful objects is fun to wear, adds joy to the wearer and all who sees it. It allows the wearer to be more self-expressive and creative.

The embodiments of the headwear described and shown have been necessarily specific for purposes of illustration. The aim of the appended claims is to cover all variations, within the spirit and scope of the embodiments, rather than by the examples given.

I claim:

1. A head covering specifically but not exclusively for people experiencing hair loss comprising:

(a) a cap portion having a main outer cloth member for covering the head, said cap portion having a periphery including a curved upper crown and a straight bottom edge;

(b) a band consisting of an elongated fabric strip, said elongated fabric strip including a straight upper edge and a curved lower edge, said straight bottom edge of said cap portion and said straight upper edge of said band fastened together in a contiguous manner, said curved lower edge of said band following a pathway across the lower brow in a space just above the eyes wherein upon reaching just beyond the corner of the eye at the temple said pathway curves slightly downward and slightly towards the front of the face to the uppermost point of the cheekbone before said pathway curves in an upward arch back towards the rear of the head transecting the ear at mid-point to a point just beyond the ear wherein said pathway curves downwardly ending just below the hairline wherein said pathway continues, following just below the hairline, to the center of rear of the head where opposite ends of said band converge, wherein said head covering provides a secure, comfortable, and complete fit to the portion of the head typically covered by hair, this coverage particularly crucial in the event of hair loss, along with said head covering providing a flattering frame to the face.

2. A head covering of claim 1 wherein said cap portion further includes 6 triangular pieces of fabric of equal size and shape, said main outer cloth member substantially conforming to the shape of said cap portion allowing for a secure fit.

3. A head covering of claim 1 wherein said cap portion further comprises a lining, said lining including 6 triangular pieces of fabric of equal size and shape, said lining substantially conforming to the shape of said cap portion allowing for comfort in fit.

4. A head covering of claim 1 wherein said cap portion further includes a quilted filler, said quilted filler including 6 triangular pieces of equal size and shape, said quilted filler substantially conforming to the shape of said cap adding comfort to scalp and structure to said cap portion.

5. A head covering of claim 1 wherein said opposite ends of said band converge, said band is provided with means for at least partially adjusting a rear length of said band, the adjustments to accommodate said band to different neck lengths.

6. A head covering of claim 5 wherein said means for at least partially adjusting the rear length of said band include snaps.

7. A head covering of claim 1 wherein said cap portion further includes a plurality of fasteners attached to exterior of said cap portion, said plurality of fasteners attached in no particular order, said plurality of fasteners projecting from said cap portion to add height and interest to said cap portion.

8. A head covering of claim 7 wherein said plurality of fasteners comprises rings comprising plastic, acrylic, metal or rubber, said rings to be of a predetermined size.

9. A head covering of claim 7 wherein said cap portion further includes permanent and detachable artful strands, wherein said artful strands are provided with means for securing attachment to said plurality of fasteners, thereby providing an outlet for self expression for the wearer.

10. A head covering of claim 9, wherein said means for securing attachment to said plurality of fasteners includes split rings, safety pins or jump rings.

11. A head covering of claim 9 wherein said artful strands further includes two and three dimensional objects, said two and three dimensional objects being of a predetermined size, shape, and length, wherein a connecting fastener is used to interconnect said two and three dimensional objects, said connecting fastener selected from a group consisting of metal and plastic.

12. A head covering of claim 9 wherein said artful strands further include two and three dimensional flowers, said flowers comprising scrap booking paper, said paper including a protective covering.

13. A head covering of claim 11 wherein said three dimensional objects include beads and buttons, comprising glass and plastic.

* * * * *